US006182754B1

(12) United States Patent
Vermeeren

(10) Patent No.: US 6,182,754 B1
(45) Date of Patent: Feb. 6, 2001

(54) HELICAL SCRAPER APPARATUS FOR A RECIPROCATING SUCKER ROD

(75) Inventor: Thomas Hubert Vermeeren, Spruce Grove (CA)

(73) Assignee: RG Industries Ltd., Calgary (CA)

( * ) Notice: Under 35 U.S.C. 154(b), the term of this patent shall be extended for 0 days.

(21) Appl. No.: 09/145,048

(22) Filed: Sep. 1, 1998

(30) Foreign Application Priority Data

Nov. 19, 1997 (CA) ..... 2221514

(51) Int. Cl.[7] ..... E21B 37/00; E21B 37/02; E21B 17/10

(52) U.S. Cl. ..... 166/176; 166/241.4

(58) Field of Search ..... 166/173, 176, 166/177.3, 241.4, 304, 311

(56) References Cited

U.S. PATENT DOCUMENTS

| | | | | |
|---|---|---|---|---|
| 1,755,762 | * | 4/1930 | Armstrong et al. | 166/175 |
| 3,044,552 | * | 7/1962 | Clairborne | 166/170 |
| 3,083,772 | * | 4/1963 | Tripplehorn | 166/176 |
| 3,176,771 | * | 4/1965 | Clairborne et al. | 166/173 |
| 3,329,212 | * | 7/1967 | Pourchot | 166/176 |
| 4,532,988 | | 8/1985 | Hickman | 166/176 |
| 5,115,863 | | 5/1992 | Olinger | 166/241 |
| 5,277,254 | | 1/1994 | Rullman et al. | 166/241.1 |
| 5,339,896 | | 8/1994 | Hart et al. | 166/241.1 |
| 5,358,041 | | 10/1994 | O'Hair | 166/241.1 |
| 5,570,742 | * | 11/1996 | Reynolds et al. | 166/173 |

FOREIGN PATENT DOCUMENTS

| | | | |
|---|---|---|---|
| 2101677 | 6/1994 | (CA) | E21B/17/10 |
| 2173523 | 11/1996 | (CA) | E21B/17/10 |

OTHER PUBLICATIONS

Brochure from Huber Flow Control for New Era Progressing Cavity NEPC Rod Guides, 1 page (double sided), undated.

* cited by examiner

*Primary Examiner*—Paul N. Dickson
*Assistant Examiner*—Joselyn Z. Sliteris
(74) *Attorney, Agent, or Firm*—David and Bujold

(57) ABSTRACT

A scraper apparatus for a reciprocating sucker rod for prevention of the wearing of grooves in well tubing. The scraper is formed by a body with two opposed spiral vanes extending 180 degrees around the body and defining flow channels positioned between the spiral vanes. The scraper is secured to the reciprocating sucker rod and is positioned within the well tubing. The well tubing has an inner circumference with the two opposed spiral vanes engaging 360 degrees of the inner circumference of the well tubing while enabling fluids to bypass the body through the flow channels.

7 Claims, 2 Drawing Sheets

HELICAL SCRAPER APPARATUS FOR A RECIPROCATING SUCKER ROD

FIELD OF THE INVENTION

The present invention relates to a method of preventing parafin wax scrapers on a reciprocating sucker rod from wearing grooves in the interior walls of well tubing, and a scraper constructed in accordance with the method.

BACKGROUND OF THE INVENTION

Sucker rod scrapers are attached to reciprocating sucker rods in order that paraffin wax may be scraped from well tubing as the sucker rod reciprocally moves up and down. The form of scraper in most common usage consists of a plurality of parallel vanes with channels for the flow of fluids between the vanes. The problem with these scrapers is that over prolonged usage the vanes moving up and down wear grooves in the well tubing.

Helical scrapers have been used in an effort to avoid wear grooves. The theory behind helical scrapers is that they provide even wear around the 360 degree inner circumference of the well tubing and do a better job of cleaning paraffin wax from the well tubing. An example of a helical scraper is U.S. Pat. No. 4,532,988 which issued in 1985. One problem with such helical scrapers is that they constrict the flow of fluids up the well tubing. Another problem with such helical scrapers is that the flow of fluids along the 360 helical flight of the scraper tends to exert a torsional force upon the sucker rod.

SUMMARY OF THE INVENTION

What is required is a method of preventing scrapers on a reciprocating sucker rod from wearing grooves in well tubing while providing less restriction of fluid flow and less torsional force.

According to one aspect of the present invention there is provided a method of preventing scrapers on a reciprocating sucker rod from wearing grooves in well tubing. The first step involves providing at least one scraper having a body with two opposed spiral vanes each of which extends 180 degrees around the body and flow channels positioned between the spiral vanes. The second step involves securing the scraper to a reciprocating sucker rod. The third step involves positioning the sucker rod within well tubing having an inner circumference with the two opposed spiral vanes engaging 360 degrees of the inner circumference of the well tubing while fluids bypass the body by means of the flow channels.

With the method, as described above, there is still 360 degree coverage of the well tubing but with less restriction of fluid flow through the well tubing and less torsional force being exerted upon the sucker rod.

According to another aspect of the present invention there is provided a sucker rod scraper which includes a hub-like body. The body has two opposed spiral vanes each of which extend 180 degrees around the body. Means are provided for securing the body to a sucker rod.

According to another aspect of the present invention there is provided a sucker rod scraper/sucker rod combination which includes a sucker rod having an elongate cylindrical body. At least one sucker rod scraper is secured to the sucker rod. Each sucker rod scraper includes a hub-like body disposed around the elongate cylindrical body of the sucker rod. The hub-like body has two opposed spiral vanes each of which extend 180 degrees. Flow channels are positioned between the spiral vanes. The flow channels have opposed ends parallel to the body of the sucker rod, such that flow both enters and exits the flow channels parallel to the elongate cylindrical body of the sucker rod.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
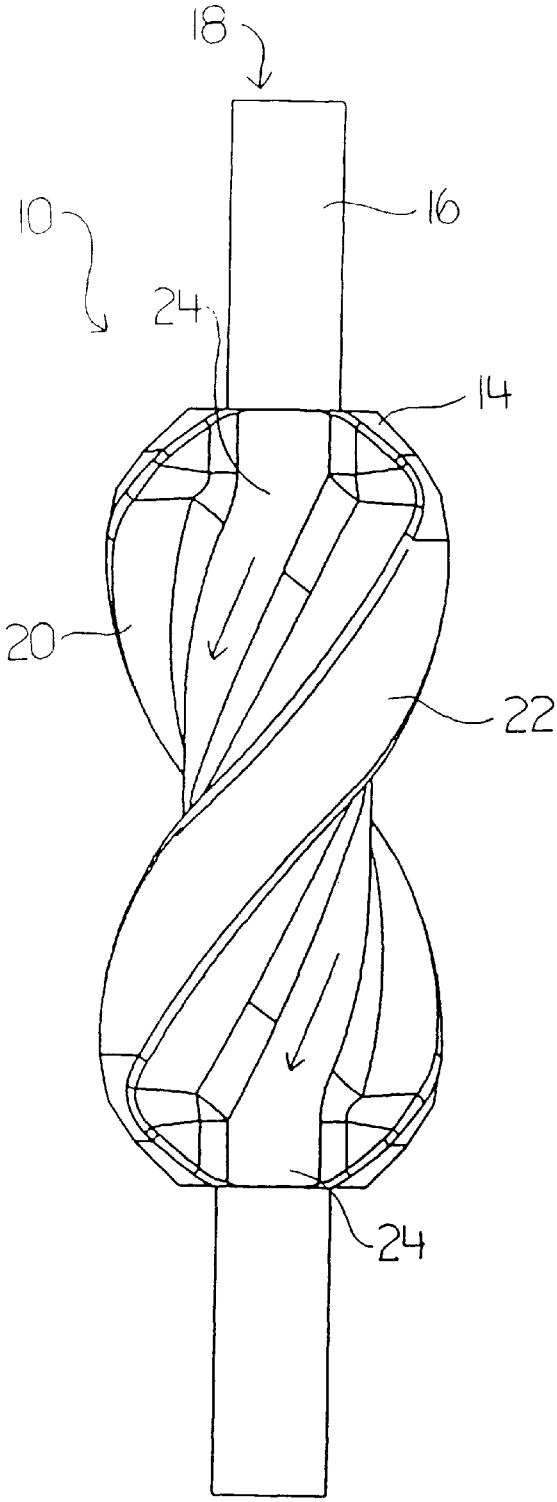
FIG. 1 is a side elevation view of a sucker rod scraper constructed in accordance with the teachings of the present invention.

The preferred embodiment, a sucker rod scraper generally identified by reference numeral 10, will now be described with reference to FIG. 1.

Sucker rod scraper 10 has a hub-like body 14 that fits around an elongate body 16 of a sucker rod 18. Hub-like body 14 has two opposed spiral vanes 20 and 22 each of which extend 180 degrees around hub-like body 14. Flow channels 24 are positioned between spiral vanes 20 and 22. The flow channels have opposed ends parallel to the body of the sucker rod, such that flow both enters and exits the flow channels parallel to the elongate cylindrical body of the sucker rod.

There are a variety of ways that sucker rod scraper 10 may be attached to a sucker rod 18. The method that is preferred is by injection molding sucker rod scraper 10 directly onto sucker rod 18. This avoids the potential for gaps that arise when slots are provided to snap lock a body onto a sucker rod, and provides a stronger bond.

Sucker rod scraper 10, as described above, solves problems experienced with wear grooves by providing 360 degree coverage of the well tubing. This both permits it to do a better job of cleaning paraffin wax from the well tubing, and ensures that any wear which occurs is spread over the 360 degree coverage area. The vanes can be anywhere from ½ an inch to 1 inch in width; it is preferred that wide vanes be used to increase the erodible volume. The vanes can be of a length from 2 inches to 12 inches; it is preferred that sucker rod scraper 10 be made toward the upper end of that range so as to increase the erodible volume and decrease the angle of the spiral. The vanes can be either a right hand or a left hand spiral.

Figure 2:
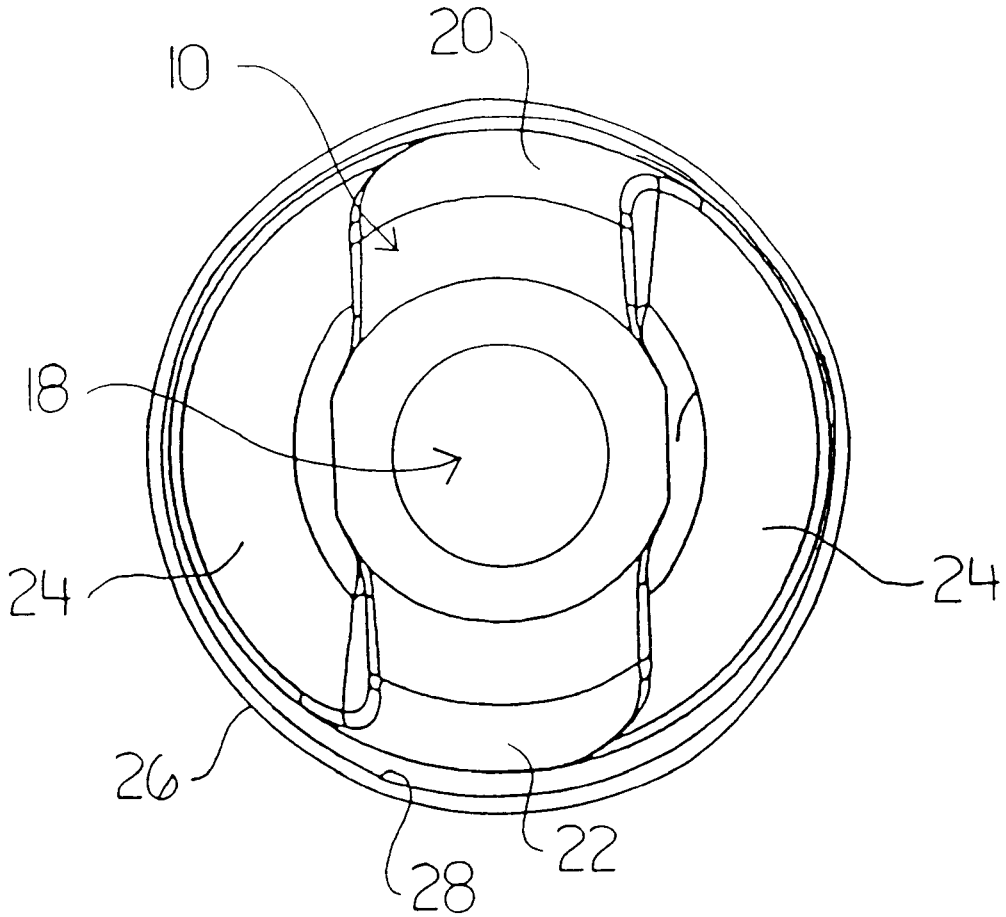
FIG. 2 is a top plan view of the sucker rod scraper illustrated in FIG. 1 disposed in well tubing.

Referring to FIG. 2, scraper 10 is illustrated positioned in well tubing 26 in accordance with the teachings of the preferred method. The first step involves providing scraper 10 as described above. The second step involves securing scraper 10 to reciprocating sucker rod 18. The third step involves positioning sucker rod 18 within well tubing 26 having an inner circumference 28 with opposed spiral vanes 20 and 22 engaging 360 degrees of inner circumference 28 of well tubing 26 while fluids bypass body 14 by means of flow channels 24.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A sucker rod scraper/sucker rod combination, comprising:

a sucker rod having an elongate cylindrical body;

at least one sucker rod scraper including a hub-like body disposed around the elongate cylindrical body of the sucker rod, the hub-like body having two opposed spiral vanes each of which extend 180 degrees around the elongate cylindrical body; and flow channels positioned between the spiral vanes, the flow channels having opposed ends parallel to the body of the sucker rod, such that flow both enters and exits the flow channels parallel to the elongate cylindrical body of the sucker rod.

2. The sucker rod scraper/sucker rod combination as defined in claim 1, wherein the body of the sucker rod scraper is molded onto the elongate cylindrical body of the sucker rod.

3. The sucker rod scraper/sucker combination as defined in claim 1, wherein the sucker rod is adapted for use in a reciprocating application.

4. A sucker rod scraper and sucker rod combination, the combination comprising:

a sucker rod having an elongate cylindrical body;

at least one sucker rod scraper including a hub-like body located along and disposed around the elongate cylindrical body of the sucker rod, the hub-like body having two opposed spiral vanes which each extend 180 degrees around a periphery of the elongate cylindrical body;

a pair of opposed flow channels positioned between the two opposed spiral vanes, each of the pair of opposed flow channels having a pair of opposed inlets and outlets which extend parallel to the elongate cylindrical body of the sucker rod such that a flow of fluid axially along the elongate cylindrical body enters the pair of opposed inlets, of the pair of flow channels, while flowing parallel to the elongate cylindrical body of the sucker rod and the flow of fluid exits the pair of opposed outlets, of the pair of opposed flow channels, while flowing in a direction parallel to the elongate cylindrical body of the sucker rod.

5. The sucker rod scraper of claim 4, wherein the two opposed spiral vanes each have a length of between 2 inches and 12 inches.

6. The sucker rod scraper of claim 4, wherein the two opposed spiral vanes each have a thickness width of between ½ inch and 1 inch.

7. A sucker rod scraper and sucker rod combination, the combination comprising:

a sucker rod having an elongate cylindrical body defining a longitudinal axis;

at least one sucker rod scraper including a hub-like body located along and disposed around the elongate cylindrical body of the sucker rod, the hub-like body having two opposed spiral vanes which each extend 180 degrees around a periphery of the elongate cylindrical body; and said two opposed spiral vanes each having an axial length of between 2 inches and 12 inches and a spiral vane thickness of between ½ inch and 1 inch;

a pair of opposed flow channels formed between the two opposed spiral vanes, each of the pair of opposed flow channels having a pair of opposed inlets and outlets which extend parallel to the elongate cylindrical body of the sucker rod such that a flow of fluid axially along the elongate cylindrical body enters the pair of opposed inlets, of the pair of flow channels, while flowing parallel to the elongate cylindrical body of the sucker rod and the flow of fluid exits the pair of opposed outlets, of the pair of opposed flow channels, while flowing in a direction parallel to the elongate cylindrical body of the sucker rod.

* * * * *